US011229305B1

(12) United States Patent
Allen

(10) Patent No.: US 11,229,305 B1
(45) **Date of Patent: *Jan. 25, 2022**

(54) CUP OR GLASS FOR RETAINING A FLAT PLANAR OBJECT, SUCH AS A STANDARD-SIZED CREDIT CARD, BUSINESS CARD OR CURRENCY, INCLUDING FOLDED CURRENCY

(71) Applicant: Peter Allen, Hillsboro Beach, FL (US)

(72) Inventor: Peter Allen, Hillsboro Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/321,469

(22) Filed: May 16, 2021

Related U.S. Application Data

(63) Continuation-in-part of application No. 16/809,099, filed on Mar. 4, 2020, now Pat. No. 11,006,772.

(51) Int. Cl.
*A47G 23/00* (2006.01)
*A47G 19/22* (2006.01)

(52) U.S. Cl.
CPC ..... *A47G 19/2205* (2013.01)

(58) Field of Classification Search
CPC . A45C 1/12; G07D 9/02; G07D 9/004; G07D 9/002; A47G 23/0216; A47G 19/22; B65D 81/3875
USPC ..... 206/0.8, 0.81
See application file for complete search history.

(56) References Cited

U.S. PATENT DOCUMENTS 5,881,788 A * 3/1999 Hersh ..... A45C 3/06 150/116
2018/0111328 A1* 4/2018 Ellis ..... A45C 1/00

* cited by examiner

*Primary Examiner* — King M Chu
(74) *Attorney, Agent, or Firm* — Edwin D. Schindler

(57) ABSTRACT

A cup or glass is able to retain currency, either folded or unfolded, or a flat planar object, such as a standard-sized credit card or business card, in a slit located in the side of the cup or glass. Alternatively, two slits can be located in opposite sides of the upper rim of the cup or glass for permitting the two slits to jointly retain the credit card, business card or currency, or similar object, in the upper rim of the cup or glass. The cup or glass may have multiple slits for simultaneously retaining more than one credit card, more than one business card or several currency bills or, simultaneously, a combination thereof.

18 Claims, 9 Drawing Sheets

CUP OR GLASS FOR RETAINING A FLAT PLANAR OBJECT, SUCH AS A STANDARD-SIZED CREDIT CARD, BUSINESS CARD OR CURRENCY, INCLUDING FOLDED CURRENCY

CROSS-REFERENCE TO PRIOR APPLICATION

This is a continuation-in-part of U.S. patent application Ser. No. 16/809,099, filed Mar. 4, 2020.

BACKGROUND OF THE INVENTION

Technical Field of the Invention

The present invention relates, generally, to a cup or glass for retaining a flat planar object, such as a credit card, a business card or currency.

More particularly, the present invention relates to a cup or glass having at least one slit for receiving and retaining the edge of an object that is shaped as a credit card, a debit card, a business card or currency, which currency may be unfolded or folded.

Description of the Prior Art

It is common practice at many restaurants and bars to present a customer with a "check" for food and drink at the completion of service for payment and to do so by placing the check in a cup, which is generally made of glass. The customer can place payment in cash into the glass, though, more commonly, payment is made via credit card and the credit card is either placed on top of the glass, beneath the glass or entirely separate from the glass. The inner circumference of the glass itself is generally smaller than the width of the credit card rendering this option physically impossible or impractical.

SUMMARY OF THE INVENTION

It is therefore an object of the present invention to provide a cup, such as a glass, that is capable of retaining a flat planar object, such as a credit card, a debit card, a business card or currency, which currency may be folded or unfolded.

It is a further object of the present invention to provide a cup, such as a glass, that is capable of retaining a standard-sized credit card or currency in an outer side of the cup or glass for permitting a customer at a bar or restaurant to offer payment of a check that is retained in the cup or glass by placement of the credit card or currency in either the outer side or top rim of the cup or glass.

It is still a further object of the present invention to provide a cup, such a glass, that is capable of retaining a standard-sized credit card, a business card or currency, whether the currency is folded or unfolded, by the provision of at least one slit along with the outer side of the cup or glass, or two slits in opposite sides of the top rim of the cup or glass for retention of the flat planar object, such as a standard-sized credit card.

The foregoing and related objects are accomplished by the cup or glass of the present invention, which is capable of retaining a flat planar object, such as a standard-sized credit card, a business card or currency, whether folded or unfolded, in a slit located in the side of the cup or glass and accessible from the outside of the cup or glass.

Alternatively, two slits can be located in opposite sides of the upper rim of the cup or glass for permitting the two slits to jointly retain the credit card, or similar object, in the upper rim of the cup or glass.

For purposes of the disclosure of the present invention, the terms "cup" and "glass" will be used interchangeably, though it is anticipated that a glass would be used in commercial restaurants and bars. Similarly, "credit card' shall be understood as including debit cards and other flat planar objects, in addition to business cards, or United States or foreign currency, whether folded or unfolded, whether or not intended for payment in a commercial establishment.

The standardized size of credit cards is 85.60×53.98 mm (3.370×2.125 inches) and having rounded corners with a radius of 2.88-3.48 mm, in accordance with ISO/IEC 7810 #ID-1, and with credit cards being the same size as ATM cards and other payment cards, such as debit cards. All such card sizes have a thickness of 0.76 mm (1/32-inch.)

The standardized size of United States currency (when not otherwise torn or damaged, and unfolded) is approximately 2.61 inches wide by approximately 6.14 inches long, and the thickness is approximately 0.0043 inches. It is within the scope of the present invention to include unfolded and folded currency to be held within one or more slits of the cup of the present invention, whether along the side or top rim of the cup, as well as currency that may be torn and not otherwise of the precise dimensions specified above, though of the foregoing dimensions prior to damage.

Additionally, the cup or glass of the present invention can be used to retain a business card that, by way of example, a patron might wish to leave with the commercial establishment or other location, for permitting later correspondence between the patron and the commercial or non-commercial establishment. The standard size of a business card in the United States is approximately 3.5 inches by approximately 2 inches or, as expressed metrically, approximately 8.9 cm by approximately 5.1 cm. The business card may either be placed in slits in the top rim of the cup of the invention or in a side slit of the inventive cup.

The cup or glass may have multiple slits for simultaneously retaining more than one credit card, more than one business card or several currency bills or, simultaneously, any combination thereof.

Other objects and features of the present invention will become apparent when considered in combination with the accompanying drawing figures, which illustrate certain preferred embodiment of the present invention. It should, however, be noted that the accompanying drawing figures are intended to illustrate only select preferred embodiments of the claimed invention and are not intended as a means for defining the limits and scope of the invention.

BRIEF DESCRIPTION OF THE DRAWING FIGURES

In the drawing figures, wherein similar features are denoted with similar reference numerals throughout the several views.

Figure 8:
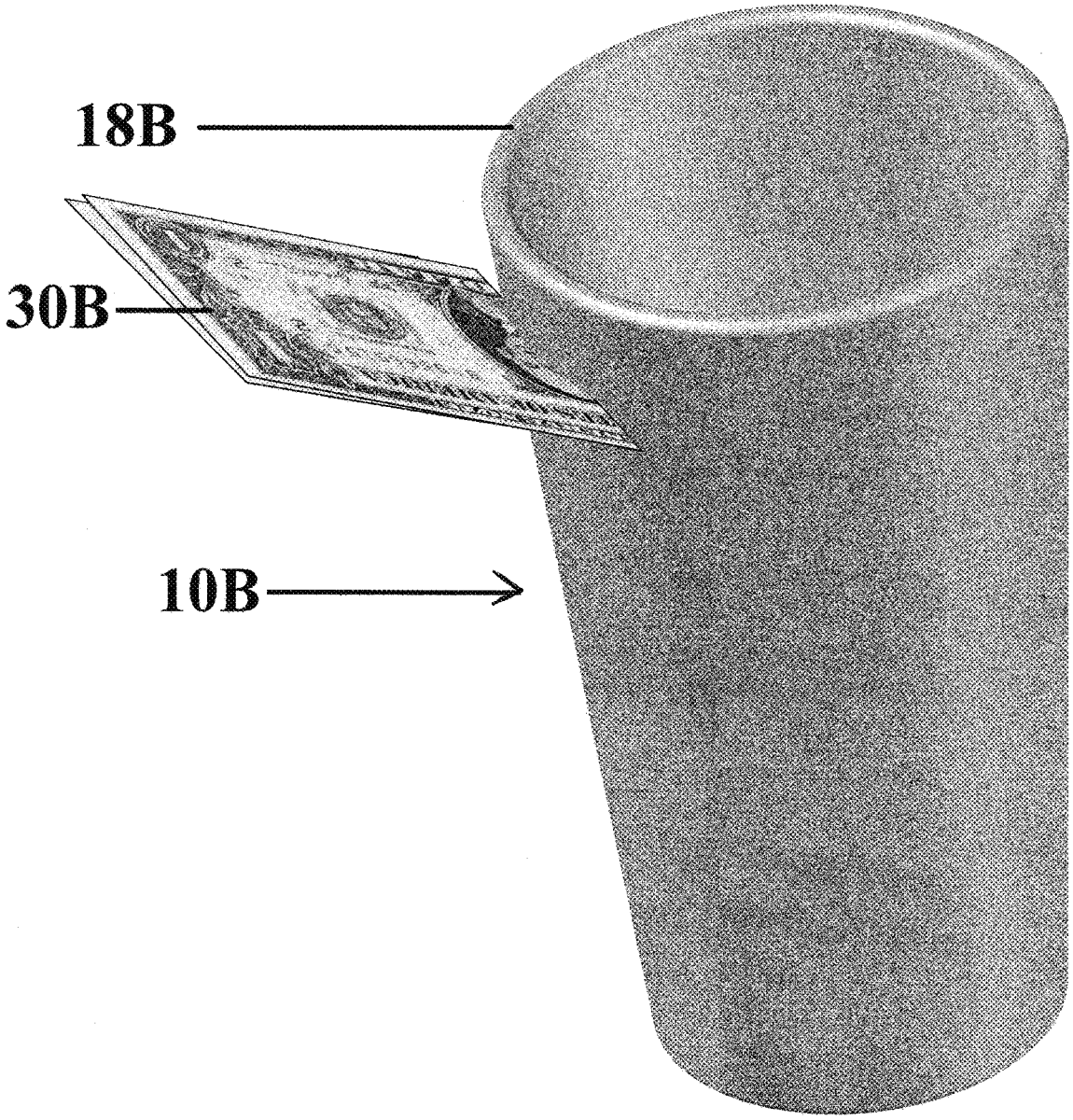
Figure 9:
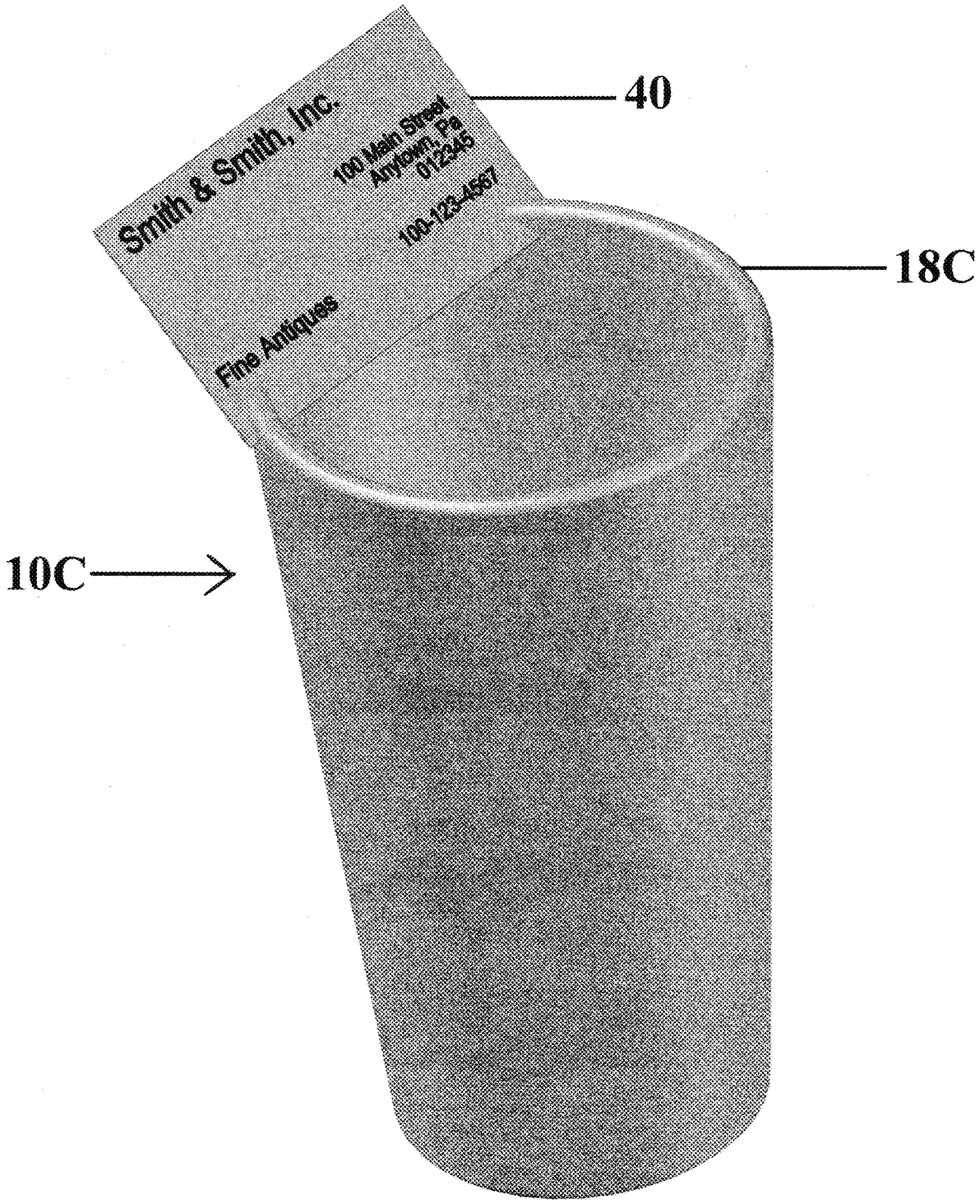

FIG. 8 is a perspective view of a glass retaining folded United States currency in an outer side surface of the glass in close proximity to the top of the glass; and, FIG. 9 is a perspective view of a flat planar object, such as a standard-sized business card being retained in, and at an angle to, the upper rim of a glass by two slits located in opposite sides of the upper circumferential rim of the glass.

DETAILED DESCRIPTION OF THE DRAWING FIGURES AND PREFERRED EMBODIMENTS

Figure 1:
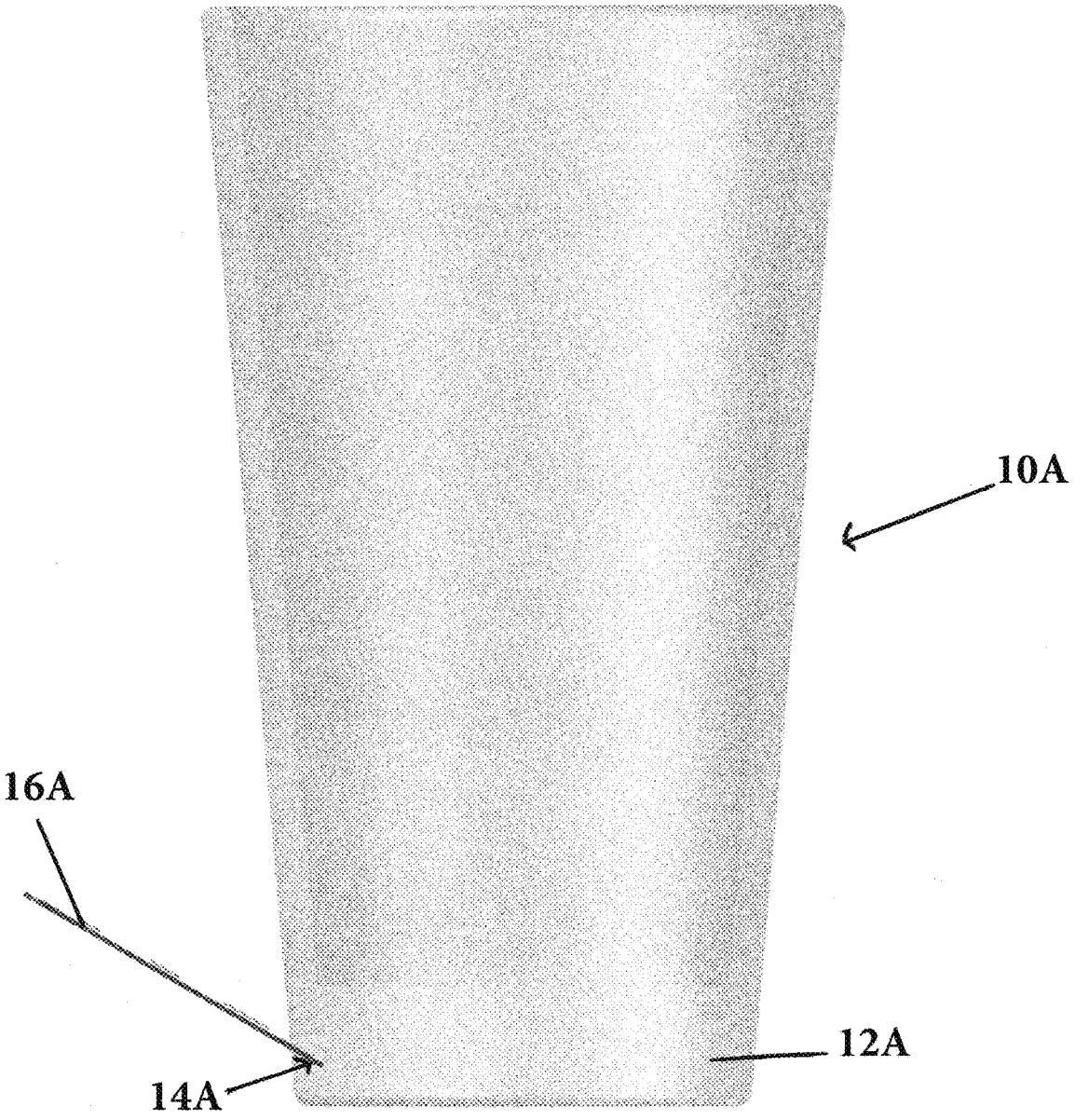
FIG. 1 is an elevational view of a glass having a flat planar object, such as a standard-sized credit card, located in a slit in the outer surface of the glass in close proximity to, or in, the lower base of the glass.

Turning now, in detail, to the accompanying drawing figures, FIG. 1 presents an elevational view of a cup or glass 10A having a lower base 12A with a slit 14A located in the lower base 12A with an flat planar object 16A being retained in the lower base 12A of the glass 10A.

Figure 2:
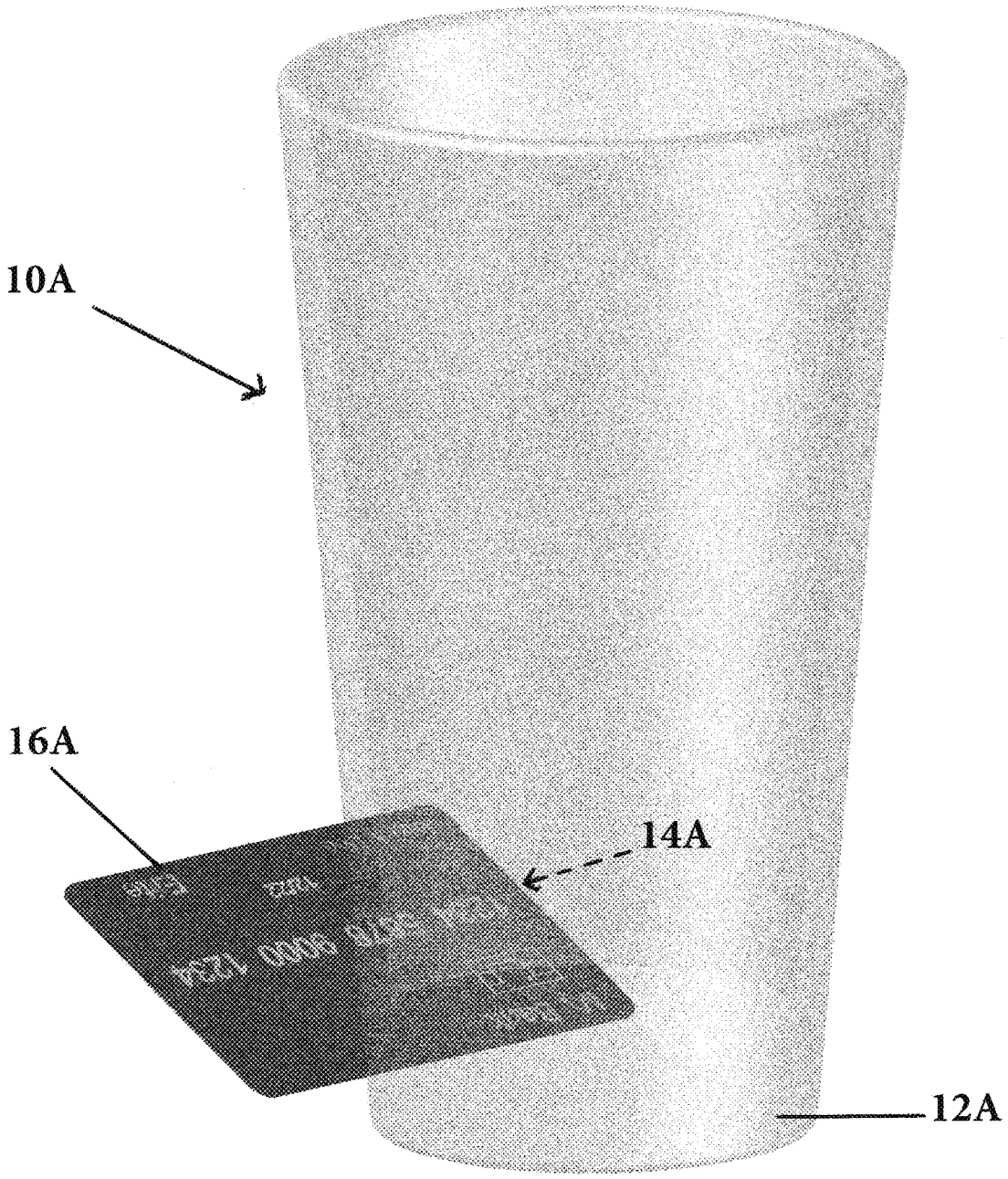
FIG. 2 is a perspective view of the glass of FIG. 1 showing a standard-sized credit card being retained in the outer surface of the glass in close proximity to, or in, the lower base of the glass.

FIG. 2 presents an alternative perspective view of the glass 10A of FIG. 1 with the lower base 12A of the glass retaining the flat planar object 16A of FIG. 1 in slit 14A, which can readily be seen in FIG. 2 as being a standard-sized credit card 16A.

Figure 3:
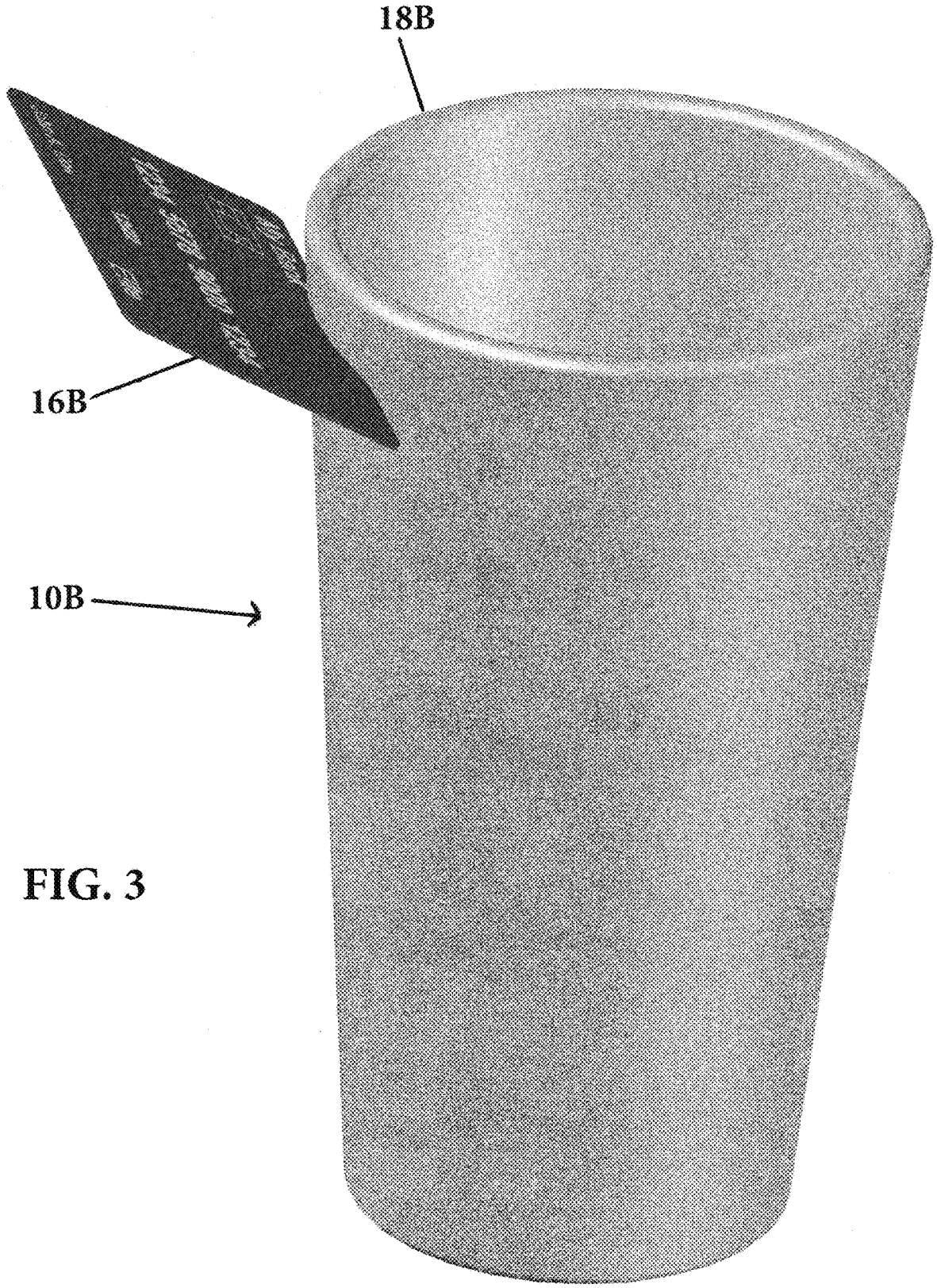
FIG. 3 is a perspective view of a glass having a flat planar object, such as a standard-sized credit card, in an outer side surface of the glass in close proximity to the top of the glass.

FIG. 3 is a perspective view of a glass 10B having a flat planar object 16B, which can be seen as being a standard-sized credit card 16B, in a portion of the outer surface of the glass 10B in close proximity to the top circumferential rim 18B of glass 10B.

Figure 4:
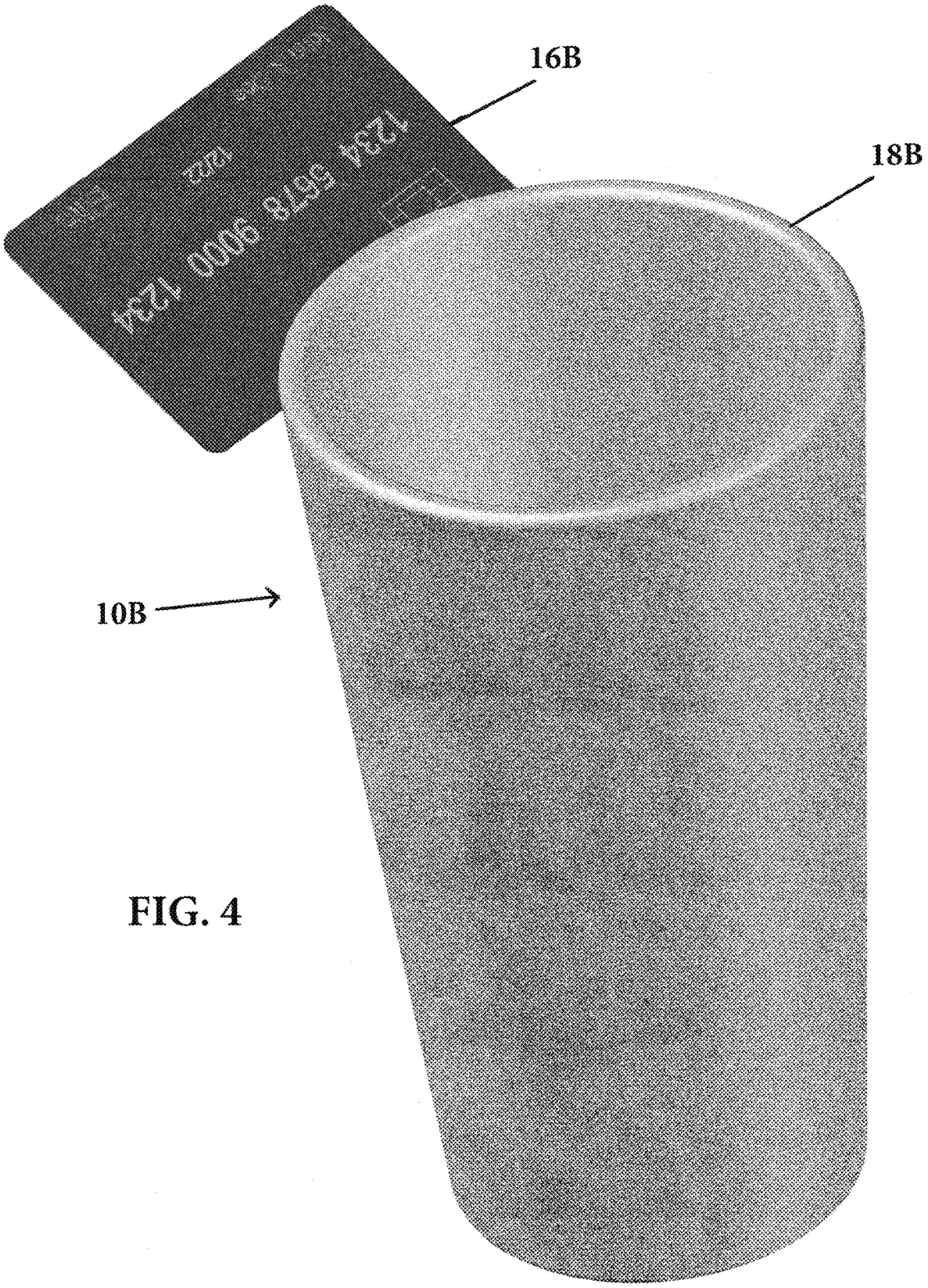
FIG. 4 is an alternative prospective view of the glass of FIG. 3 having a credit card in the outer side surface of the glass in close proximity to the top of the glass.

FIG. 4 is an alternative prospective view of the glass 10B of FIG. 3 having a credit card 16B in the outer side surface of the glass 10B in close proximity to the top circumferential rim 18B of the glass. While not shown as such in FIG. 4, it is possible for the credit card 16B to penetrate the entirety of the side of the glass 10B with a portion of the credit card being within the interior portion of the glass.

Figure 5:
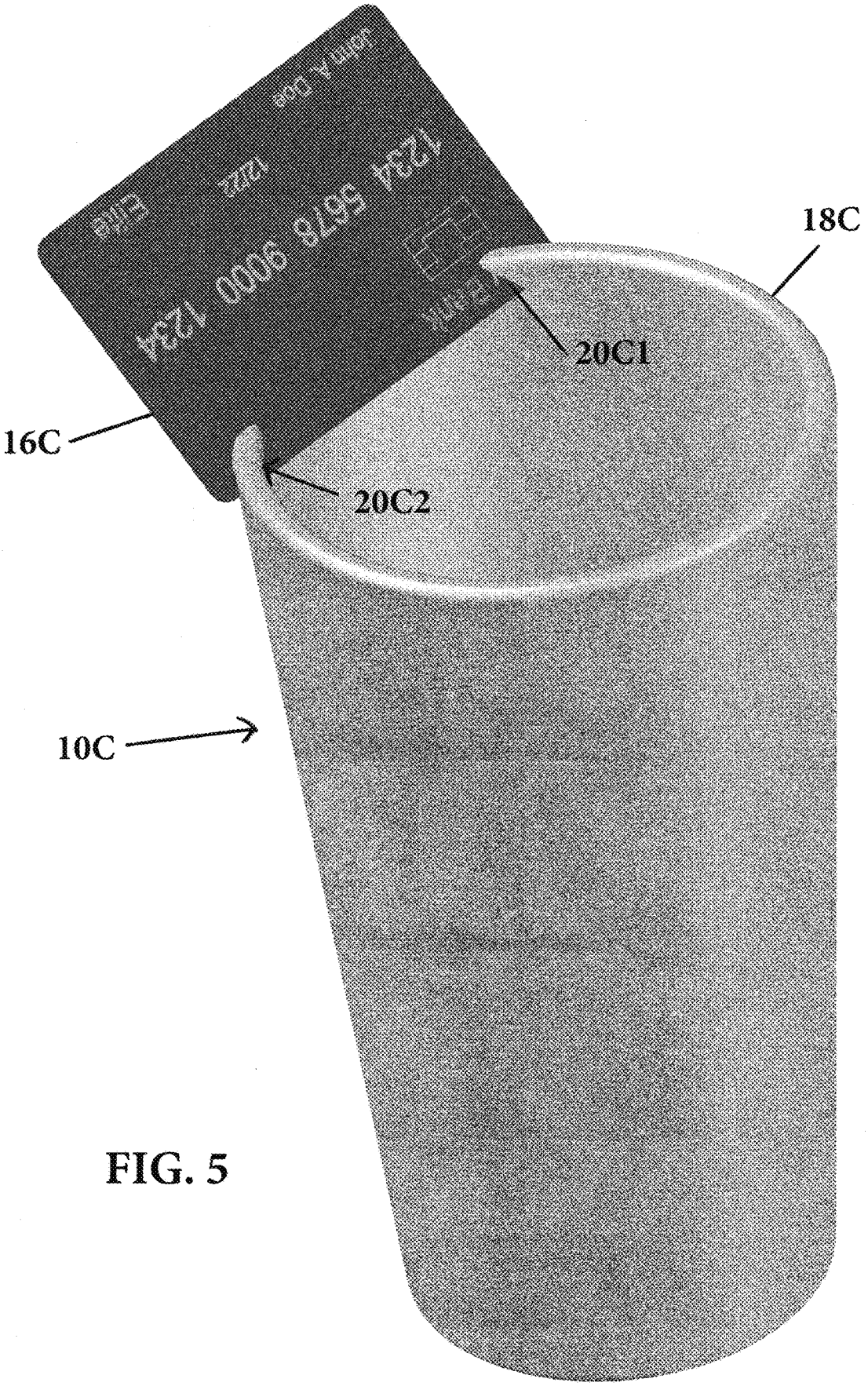
FIG. 5 is a perspective view of a flat planar object, such as a standard-sized credit card being retained in, and at an angle to, the upper rim of a glass by two slits located in opposite sides of the upper circumferential rim of the glass.

FIG. 5 is a first perspective view of a glass 10C having a flat planar object 16C, such as a credit card, being retained in the two opposing parallel slits 20C1, 20C2 in the top circumferential rim 18C of glass 10C; credit card 16C is shown as being retained by the two opposing parallel slits 20C1, 20C2 on a non-perpendicular angle relative to the top circumferential rim 18C of the glass 10C.

Figure 6:
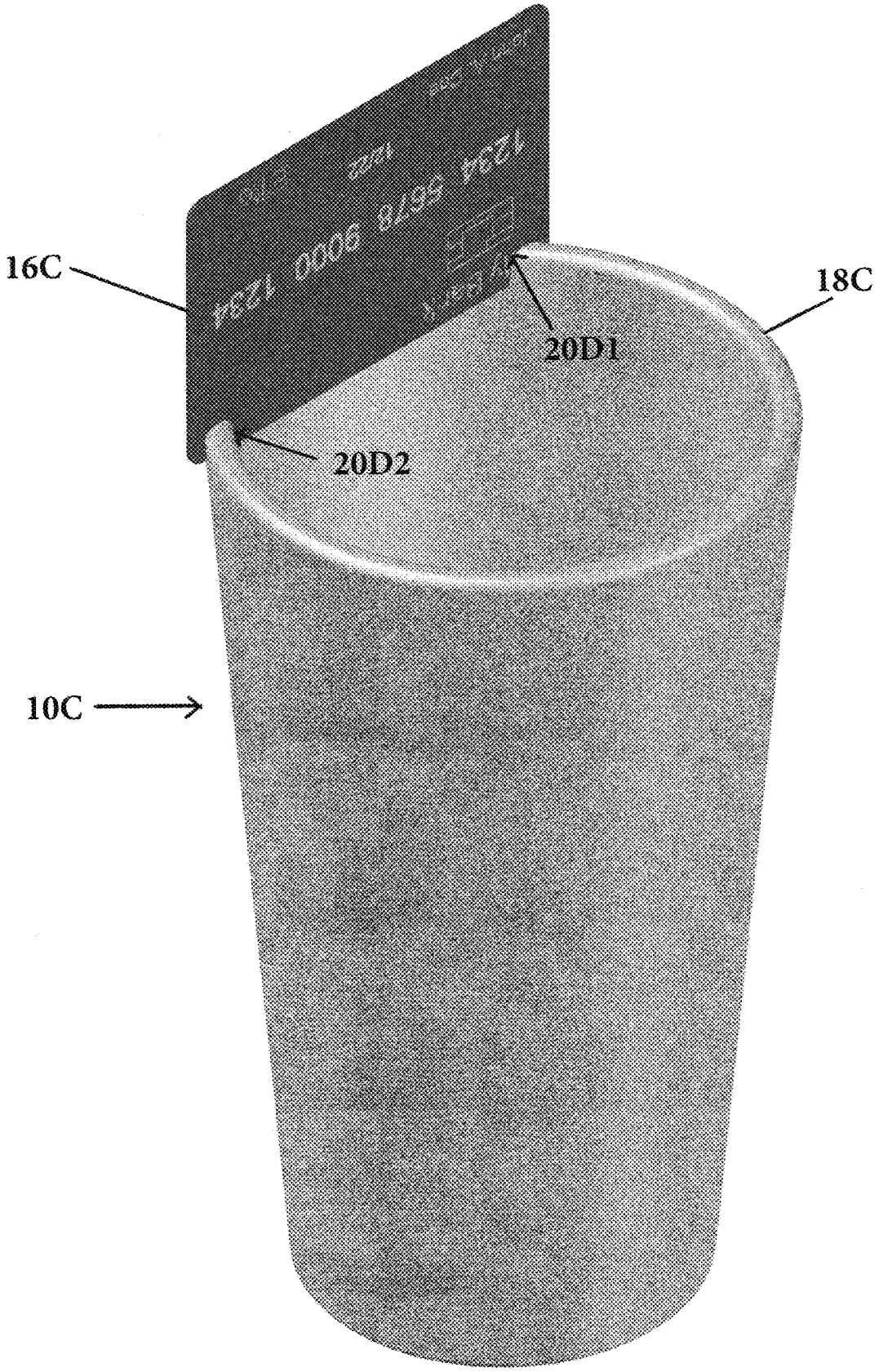
FIG. 6 is a perspective view of a flat planar object, such as a standard-sized credit card being retained in, and perpendicular to, the upper rim of a glass by two slits located in opposite sides of the upper circumferential rim of the glass.

FIG. 6 is a second perspective view of a glass 10C having a flat planar object 16C, such as a credit card, being retained in the two parallel opposing slits 20D1, 20D2 in the top circumferential rim 18C of glass 10C; credit card 16C is shown as being retained by the two opposing parallel slits 20D1, 20D2 on a perpendicular angle relative to the top circumferential rim 18C of the glass 10C.

Figure 7:
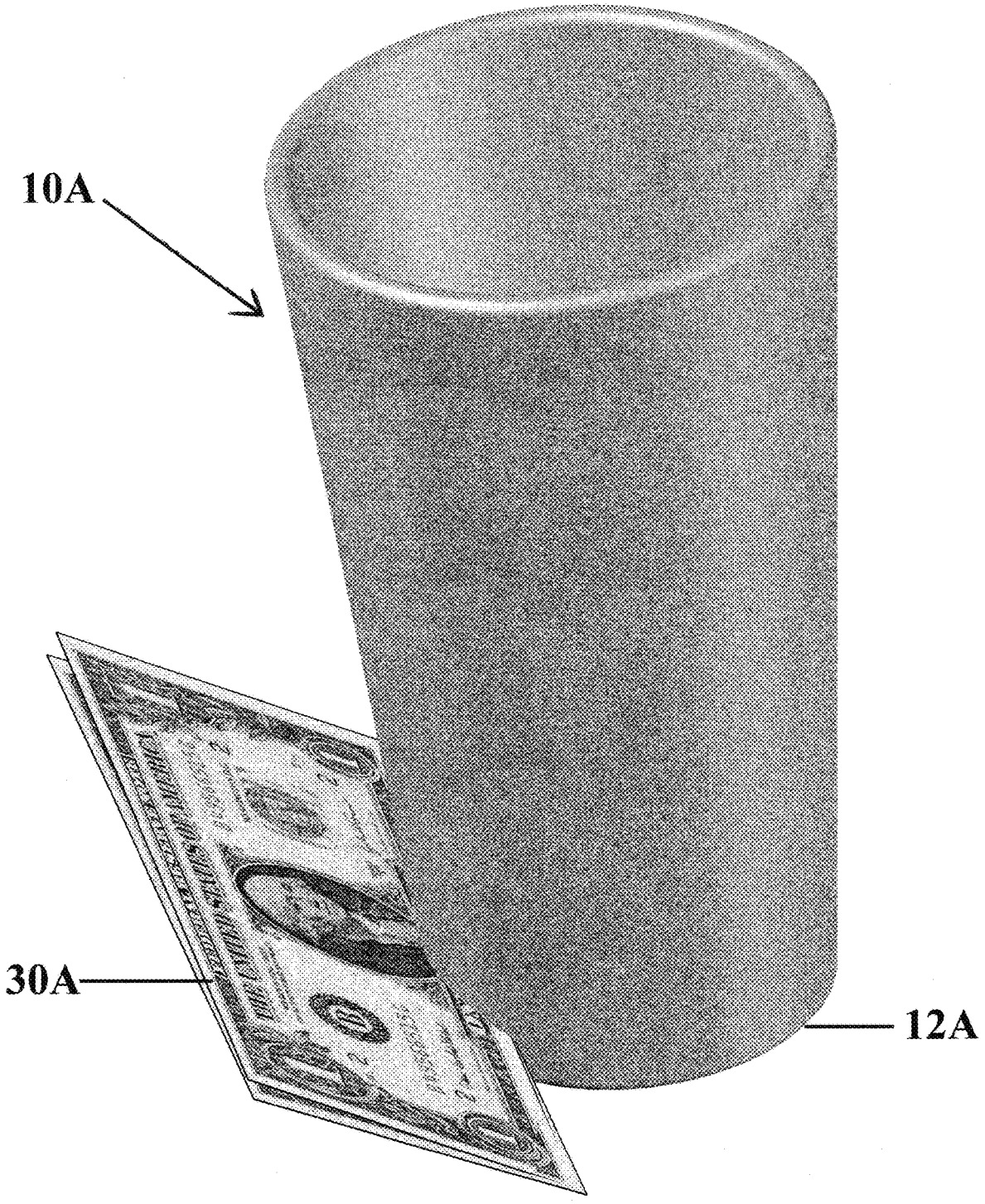
FIG. 7 is a perspective view of the glass of FIG. 1 showing unfolded United States currently being retained in the outer surface of the glass in close proximity to, or in, the lower base of the glass.

FIG. 7 presents a perspective view of the glass 10A of FIG. 1 with the lower base 12A of the glass retaining unfolded United States currency 30A in slit 14A. The unfolded currency 30A shown in FIG. 7 may be retained in any side slit of the inventive cup or in one or more slits in the upper rim of the cup or glass.

FIG. 8 is a perspective view of a glass 10B having folded United States currency 30B in a portion of the outer surface of the glass 10B in close proximity to the top circumferential rim 18B of glass 10B. The folded currency 30B shown in FIG. 8 may be retained in any side slit of the inventive cup or in one or more slits in the upper rim of the cup or glass.

FIG. 9 is a perspective view of a glass 10C having a business card 40 being retained in the two opposing parallel slits 20C1, 20C2 in the top circumferential rim 18C of glass 10C; business card 40 is shown as being retained by the two opposing parallel slits 20C1, 20C2 on a non-perpendicular angle relative to the top circumferential rim 18C of the glass 10C. The business card 40 may be retained in any side slit of the inventive cup or in slits in the upper rim that are perpendicular to the upper rim. Business cards of non-standard sizes may also be retained in the cup of the present invention.

Variations of the foregoing preferred embodiments of the present invention are possible and well within the scope of the present invention, such as, for example, the glass or card can have multiple slits for accepting a plurality of credit cards, business cards or currency or other flat planar objects at different angles, but along the side or lower base of the glass or cup, as well as within the top circumferential rim of the glass or cup.

While only several embodiments of the present invention have been shown and described, it will be obvious to those skilled in the art that many modifications may be made to the present invention without departing from the spirit and scope thereof.

What is claimed is:

1. An article in combination with currency for allowing the article to receive and retain the currency, comprising:

currency having a length of approximately 6.14 inches and a width of approximately 2.61 inches; and, a circular cup having an interior volume and at least one slit for receiving and retaining said currency in the at least one slit of said cup, said currency being retained in said at least one slit whereby a majority of the length and the width of said currency is retained outside of the interior volume of said circular cup.

2. The article in combination with currency for allowing the article to receive and retain the currency according to claim 1, wherein said currency has a thickness of approximately 0.0043 inches.

3. The article in combination with currency for allowing the article to receive and retain the currency according to claim 1, wherein said currency is folded.

4. The article in combination with currency for allowing the article to receive and retain the currency according to claim 1, wherein said currency is unfolded.

5. The article in combination with currency for allowing the article to receive and retain the currency according to claim 1, wherein said cup is made of glass.

6. The article in combination with currency for allowing the article to receive and retain the currency according to claim 1, wherein said cup has the at least one slit in an outer side of said cup for receiving and retaining said currency in the least one slit in the side of said cup.

7. The article in combination with currency for allowing the article to receive and retain the currency according to claim 1, wherein said cup includes a lower base having the at least one slit with said currency being retained in the at least one slit located in the lower base on an outer side of said cup.

8. The article in combination with currency for allowing the article to receive and retain the currency according to claim 1, wherein said cup includes a lower base and the at least one slit is in an outer side of said cup that receives and retains said currency at an obtuse angle outside of said cup relative to said lower base of said cup.

9. The article in combination with currency for allowing the article to receive and retain the currency according to claim 1, wherein said cup has a top edge and the at least one slit of said cup includes two opposing slits in said top edge of said cup for receiving and retaining said currency in the two opposing slits of said cup.

10. The article in combination with currency for allowing the article to receive and retain the currency according to claim 1, wherein the two opposing slits in said top edge of said cup are situated 180° from one another in said top edge.

11. An article in combination with a flat planar object for allowing the article to receive and retain the flat planar object, comprising:

a flat planar object having a length of approximately 3.5 inches and a width of approximately 2 inches; and, a circular cup having an interior volume and at least one slit for receiving and retaining said flat planar object in the at least one slit of said cup, said flat planar object being retained in said at least one slit whereby a majority of the length and the width of said flat planar object is retained outside of the interior volume of said circular cup.

12. The article in combination with a flat planar object for allowing the article to receive and retain the flat planar object according to claim 11, wherein said flat planar object is a business card.

13. The article in combination with a flat planar object for allowing the article to receive and retain the flat planar object according to claim 11, wherein said cup is made of glass.

14. The article in combination with a flat planar object for allowing the article to receive and retain the flat planar object according to claim 11, wherein said cup has the at least one slit in an outer side of said cup for receiving and retaining said flat planar object in the least one slit in the side of said cup.

15. The article in combination with a flat planar object for allowing the article to receive and retain the flat planar object according to claim 11, wherein said cup includes a lower base having the at least one slit with said flat planar object being retained in the at least one slit located in the lower base on an outer side of said cup.

16. The article in combination with a flat planar object for allowing the article to receive and retain the flat planar object according to claim 11, wherein said cup includes a lower base and the at least one slit is in an outer side of said cup that receives and retains said flat planar object at an obtuse angle outside of said cup relative to said lower base of said cup.

17. The article in combination with a flat planar object for allowing the article to receive and retain the flat planar object according to claim 11, wherein said cup has a top edge and the at least one slit of said cup includes two opposing slits in said top edge of said cup for receiving and retaining said flat planar object in the two opposing slits of said cup.

18. The article in combination with a flat planar object for allowing the article to receive and retain the flat planar object according to claim 17, wherein the two opposing slits in said top edge of said cup are situated 180° from one another in said top edge.

* * * * *